US007112087B2

(12) United States Patent
Tago et al.

(10) Patent No.: US 7,112,087 B2
(45) Date of Patent: Sep. 26, 2006

(54) ELECTRICAL CONNECTOR AND METHOD OF PRODUCING THE SAME

(75) Inventors: Atsuo Tago, Tokyo (JP); Masayuki Nishikata, Tokyo (JP)

(73) Assignee: Japan Aviation Electronics Industry, Ltd, Tokyo (JP)

( * ) Notice: Subject to any disclaimer, the term of this patent is extended or adjusted under 35 U.S.C. 154(b) by 254 days.

(21) Appl. No.: 10/799,648

(22) Filed: Mar. 15, 2004

(65) Prior Publication Data

US 2004/0242075 A1 Dec. 2, 2004

(30) Foreign Application Priority Data

Jun. 2, 2003 (JP) ..... 2003/156978

(51) Int. Cl.
*H01R 12/24* (2006.01)

(52) U.S. Cl. ..... 439/495

(58) Field of Classification Search ..... 439/495, 439/496, 814, 417, 354, 367–368
See application file for complete search history.

(56) References Cited

U.S. PATENT DOCUMENTS 6,749,459 B1 * 6/2004 Urbaniak et al. ..... 439/496
6,931,727 B1 * 8/2005 Bulmer et al. ..... 29/882
2002/0119696 A1 * 8/2002 Okamura et al. ..... 439/495

FOREIGN PATENT DOCUMENTS

| | | |
|---|---|---|
| DE | 3915611 | 5/1989 |
| EP | 0736936 | 10/1996 |
| EP | 1003245 | 5/2000 |
| EP | 1096609 | 5/2001 |
| JP | 2605904 | 6/2000 |

* cited by examiner

*Primary Examiner*—J. F. Duverne
(74) *Attorney, Agent, or Firm*—Baker Botts L.L.P.

(57) ABSTRACT

An electrical connector includes contacts and an insulator fixedly retaining the contacts. The insulator includes a substantially plate-like fitting portion. Each of the contacts includes a first contact portion for connection to a counterpart connector, and a second contact portion being continuous with the first contact portion and formed at a tip side of the contact. The first contact portion is disposed so as to be exposed on one side of the fitting portion, and the second contact portion is disposed such that at least part of the second contact portion is exposed at a surface of the fitting portion on the other side of the fitting portion.

10 Claims, 8 Drawing Sheets

ELECTRICAL CONNECTOR AND METHOD OF PRODUCING THE SAME

This application claims priority to prior Japanese application JP 2003-156978, the disclosure of which is incorporated herein by reference.

BACKGROUND OF THE INVENTION

The present invention relates to an electrical connector and a method of producing the electrical connector and, more specifically, relates to an electrical connector wherein active-line type contacts are overmolded, and further relates to a method of producing the electrical connector.

As the electrical connector of this type, JP-Y (Japanese Utility Model Registration) 2605904 discloses a conventional electrical connector.

The conventional electrical connector includes an insulator having a plate-like projecting portion, contacts arrayed side by side on the lower side of the projecting portion of the insulator, and a metal shell covering the circumference thereof.

Each contact has a mounting terminal portion, at one end thereof, which is joined to a board upon mounting, a retention portion retained by the insulator, a contact portion extending forward from the retention portion along the lower side of the projecting portion of the insulator, and a tip portion that is bent upward toward the inside of the projecting portion of the insulator at the front end of the contact. This connector is of the type wherein the arrayed contacts are overmolded, and the shell is provided over the circumference thereof.

A counterpart connector contains an insulator provided with a projecting portion, and contacts retained by the insulator. The projecting portion of the insulator has a front end surface formed with an opening, and a through hole is formed so as to extend backward from this opening to thereby define a contact receiving space. Each of the counterpart contacts is bifurcated so as to have a first contact portion and a second contact portion each extending up to the opening. The first contact portion has a portion projecting toward the second contact portion to thereby form a contact-point portion.

When the electrical connector and the counterpart connector are fitted together, the projecting portion of the electrical connector is sandwiched between the first and second contact portions of the contacts provided in the contact receiving space of the projecting portion of the counterpart connector so that the contact portion of each contact of the electrical connector and the contact-point portion of the first contact portion of the corresponding contact of the counterpart connector are brought into contact with each other to thereby establish electrical connection therebetween.

In the production of the conventional electrical connector, however, when overmolding the contacts with resin to produce the electrical connector, it was necessary to take a countermeasure against deflection of the contacts caused by the flow of resin upon molding.

Under the circumstances, with respect to the conventional electrical connector, a method is proposed for taking the deflection countermeasure which contains the step of providing a carrier on the fitting side of the contacts. However, inasmuch as a cutting surface of the carrier is exposed from the fitting portion, a drawback remains that short circuits between the adjacent contacts occur upon fitting to the counterpart connector.

Further, in the conventional electrical connector, since the contact portion of each contact has a contacting surface, which contacts the first contact portion of the counterpart contact, on only one side thereof, when a large force is applied in a direction where the contact moves away from the first contact portion, it may happen that the peripheral components are deflected to cause separation of the first contact portion of the contact of the counterpart connector and the contact portion of the contact of the electrical connector from each other, thus resulting in occurrence of disconnection.

SUMMARY OF THE INVENTION

Therefore, it is an object of the present invention to provide a production method of an electrical connector, which can provide a countermeasure against deflection of contacts upon molding.

It is another object of the present invention to provide an active-line type electrical connector that can ensure reliable contact with a counterpart connector even when an external force is applied to the counterpart connector.

According to one aspect of the present invention, there is provided an electrical connector which comprises contacts and an insulator fixedly retaining the contacts, wherein the insulator comprises a substantially plate-like fitting portion, each of the contacts comprises a first contact portion for connection to a counterpart connector, and a second contact portion being continuous with the first contact portion and formed at a tip side of the contact, and the first contact portion is disposed so as to be exposed on one side of the fitting portion, and the second contact portion is disposed such that at least part of the second contact portion is exposed at a surface of the fitting portion on the other side of the fitting portion.

According to another aspect of the present invention, there is provided a method of producing an electrical connector including contacts and an insulator having a substantially plate-like fitting portion that fixedly retains the contacts. The method comprising the steps of forming a contact member having integrally the contacts and a carrier provided at ends of the contacts and connecting the ends of the contacts together, forming, at the other end of each of the contacts, a first contact portion for connection to a counterpart connector, and a second contact portion being continuous with the first contact portion and formed at a tip side of the contact such that the first contact portion is exposed on one side of the fitting portion, and at least part of the second contact portion is exposed at a surface of the fitting portion on the other side of the fitting portion, fixing the first contact portions spaced apart from each other at a predetermined interval therebetween by the use of a fixing metal mold, fixing the second contact portions by the use of the fixing metal mold, and overmolding the contacts to thereby form the contacts integral with the insulator.

DESCRIPTION OF THE PREFERRED EMBODIMENT

Figure 1:
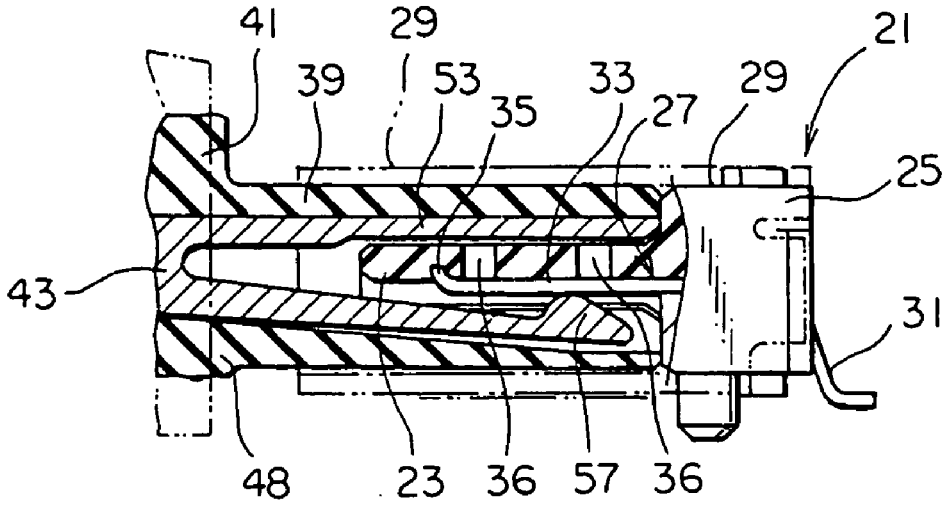
FIG. 1 PRIOR ART
FIG. 1 is a sectional view showing a normal fitting state between a conventional electrical connector and a counterpart connector.

Prior to describing a preferred embodiment of the present invention, description will be made as regards a conventional electrical connector with reference to FIGS. 1 to 4 for facilitating understanding of the present invention.

As shown in FIGS. 1 to 4, an electrical connector 21 includes an insulator 25 having a plate-like projecting portion 23, contacts 27 arrayed side by side on the lower side of the projecting portion 23 of the insulator 25, and a box-shaped metal shell 29 covering the circumference of the insulator 25 including the projecting portion 23 that serves as a fitting portion. The projecting portion 23 is formed with through holes 36 each passing through upper and lower surfaces of the projecting portion 23.

Each contact 27 has a mounting terminal portion 31, at the rear end thereof, having a shape that extends downward, then is bent to extend backward, a retention portion (not shown) retained by the insulator 25, a contact portion 33 extending forward from the retention portion along the lower side of the projecting portion 23 of the insulator 25, and a tip portion 35 that is bent upward toward the inside of the projecting portion 23 of the insulator 25 at the front end of the contact 27.

The connector 21 is of the type wherein the arrayed contacts 27 are overmolded, and the shell 29 is provided over the circumference thereof.

A counterpart connector 37 has a three-step prismatic shape and comprises an insulator 41 provided with a box-shaped projecting portion 39 having both side surfaces 42 and 44 and a bottom surface 48, and contacts 43 retained by the insulator 41. The insulator 41 contains a rectangular plate 45 having chamfered corners, a rectangular plate 47 that is one size smaller than the rectangular plate 45, and the projecting portion 39 extending forward like a flat plate from the rectangular plate 47, which are continuously arranged in an axial direction and formed integral with each other to constitute the insulator 41. The projecting portion 39 has a front end surface 46 formed with an opening 49. A through hole is formed so as to extend backward from the opening 49 to thereby define a contact receiving space. Further, in each of grooves 51 formed on both sides of an upper surface of the projecting portion 39 is provided an engaging piece 55 having an engaging claw 53 that serves to prevent detachment of the electrical connector 21 and the counterpart connector 37 from each other in directions along fitting directions of the mutual connectors when the counterpart connector 37 and the electrical connector 21 are fitted together. The engaging piece 55 is received in each groove 51 so as to support an opposite side of the engaging claw 53. The engaging piece 55 has springiness and is configured to be urged upward when the electrical connector 21 depresses the engaging claw 53, thereby to engage with the electrical connector 21.

Each of the counterpart contacts 43 is bifurcated so as to have a first contact portion 57 and a second contact portion 59 each extending up to the opening 49. The first contact portion 57 has a portion projecting toward the second contact portion 59 to thereby form a contact-point portion.

As shown in FIG. 1, when the electrical connector 21 and the counterpart connector 37 are fitted together, the projecting portion 23 of the electrical connector 21 is sandwiched between the first and second contact portions 57 and 59 of the contacts 43 provided in the contact receiving space of the projecting portion 39 of the counterpart connector 37 so that the contact portion 33 of each contact 27 of the electrical connector 21 and the contact-point portion of the first contact portion 57 of the corresponding contact 43 of the counterpart connector 37 are brought into contact with each other to thereby establish electrical connection therebetween.

In the production of the conventional electrical connector 21, however, when overmolding the contacts 27 with resin to produce the connector 21, it was necessary to take a countermeasure against deflection of the contacts 27 caused by the flow of resin upon molding.

Under the circumstances, with respect to the conventional electrical connector, there has been a method of taking the deflection countermeasure by providing a carrier on the fitting side of the contacts. However, inasmuch as a cutting surface of the carrier is exposed from the fitting portion, there has been a drawback that short circuits between the adjacent contacts occur upon fitting to the counterpart connector.

Figure 2:
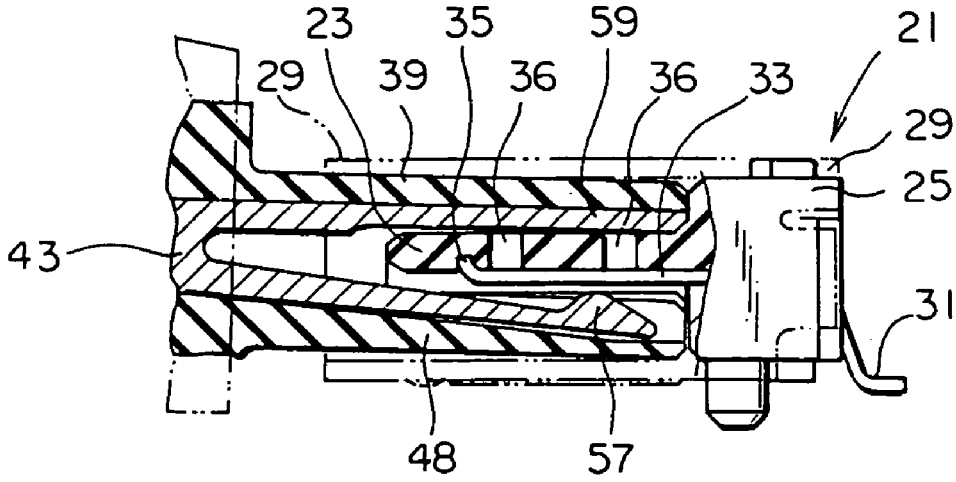
FIG. 2 PRIOR ART
FIG. 2 is a sectional view showing a slanting fitting state between the conventional electrical connector and the counterpart connector.

Further, as shown in FIG. 2, in the conventional electrical connector 21, since the contact portion 33 of each contact 27 has a contacting surface, which contacts the first contact portion 57 of the counterpart contact 43, on only one side thereof, when a large force is applied in a direction where the contact 27 moves away from the first contact portion 57, it may happen that the peripheral components are deflected to cause separation of the first contact portion 57 of the contact 43 of the counterpart connector 37 and the contact portion 33 of the contact 27 of the electrical connector 21 from each other, thus resulting in occurrence of disconnection.

Now, the preferred embodiment of the present invention will be described with reference to the drawings.

As shown in FIGS. 5 to 11, an electrical connector 61 comprises an insulator 63 having a projecting portion 67 projecting forward from a front surface 65 of the insulator 63, first and second contacts 69 and 71 supported by the insulator 63, and a shell 75 covering the circumference thereof. The shell 75 is formed with a rectangular recess 76 where a projecting portion 64 of the insulator 63 is fitted. The insulator 63 is provided on a lower surface thereof with projecting portions 82 each projecting through the shell 75. The projecting portions 82 are fitted into positioning holes (not shown) formed on a mounting board to thereby perform positioning of the electrical connector 61.

The insulator 63 comprises a box-shaped base portion 73, the plate-like projecting portion 64 formed on an upper surface of the base portion 73 in a rear part thereof, and the plate-like projecting portion 67 projecting from the front surface 65 of the base portion 73. Incidentally, holes 78 formed in the projecting portion 67 are produced by a metal mold when pressing down the first and second contacts 69 and 71 upon overmolding. Further, grooves 85 are formed on a lower surface 62 of the projecting portion 67 for receiving the contacts 69 and 71 therein.

The shell 75 covering the insulator 63 has a box shape formed by bending one plate and having a joint 77 on the lower side thereof. The shell 75 is provided with a pair of mounting pieces 79 formed by cutting and raising portions of the shell 75 and projecting laterally outward for mounting onto the board, and a pair of corner pieces 81 provided on the lower right and left sides at a front surface thereof for reinforcement.

The first and second contacts 69 and 71 supported by the insulator 63 are arranged such that the first contacts 69 are disposed at both ends in a width direction of the projecting portion 67, while the second contacts 71 are disposed inward in the width direction as compared with the first contacts 69. The first and second contacts 69 and 71 are arrayed side by side at regular pitches in the width direction.

Figure 10:
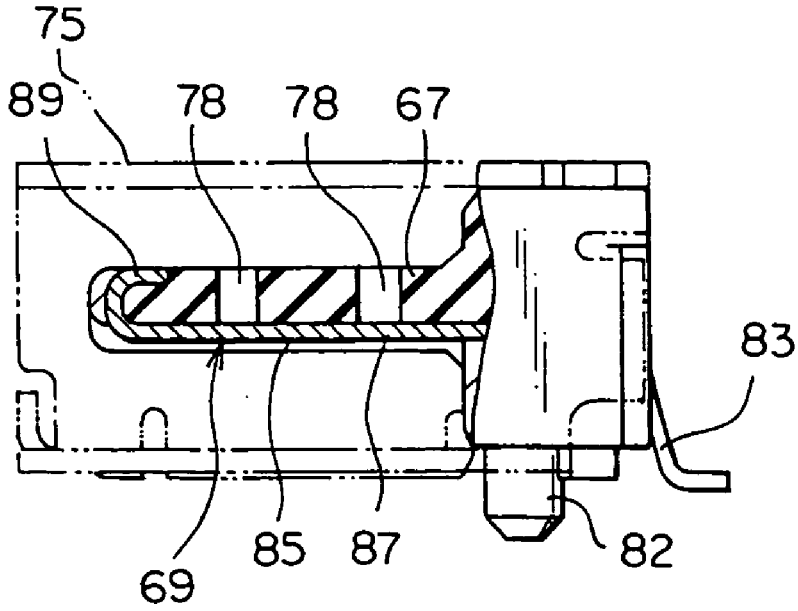
FIG. 10 is a sectional view taken along line X—X in FIG. 7.

As shown in FIG. 10, each first contact 69 has a support portion (not shown) retained by the insulator 63, a mounting terminal portion 83 extending obliquely downward in a backward direction from the support portion and then extending backward, a lower contact portion 87 extending forward from the support portion within the groove 85 provided on the lower surface of the projecting portion 67, and an upper contact portion 89 that is bent to extend upward at the front end of the lower contact portion 87, then bent to extend backward at the same level with an upper surface of the projecting portion 67. Herein, for the sake of description, the lower contact portion 87 will be referred to as the first contact portion, and the upper contact portion 89 will be referred to as the second contact portion.

Figure 11:
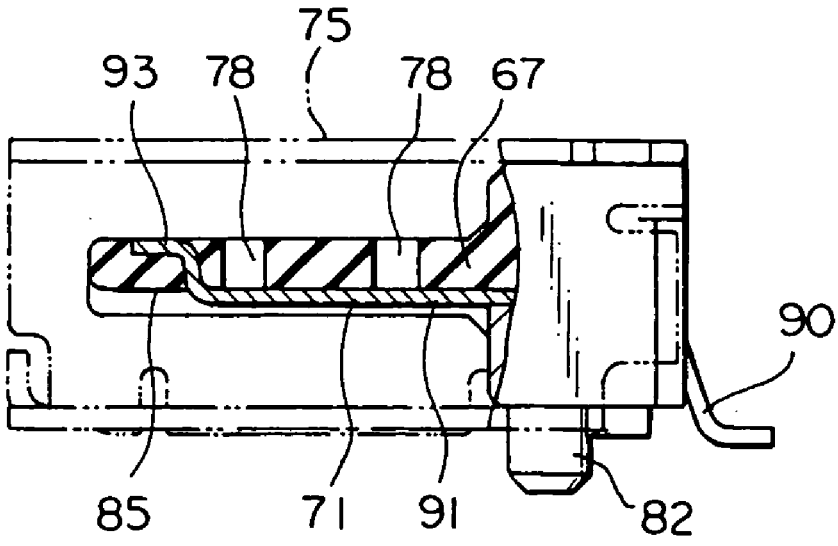
FIG. 11 is a sectional view taken along line XI—XI in FIG. 7.

As shown in FIG. 11, each second contact 71 comprises a support portion (not shown) disposed inward of the first contact portions 87 in the width direction and retained by the insulator 63, a mounting terminal portion 90 extending obliquely downward in a backward direction from the support portion and then extending backward, a lower contact portion 91 extending forward from the support portion within the groove 85 provided on the lower surface of the projecting portion 67, and an upper contact portion 93 that is bent to extend upward at the front end of the lower contact portion 91, then bent to extend forward at the same level with the upper surface of the projecting portion 67. Herein, for the sake of description, the lower contact portion 91 will be referred to as the first contact portion, and the upper contact portion 93 will be referred to as the second contact portion.

Figure 12:
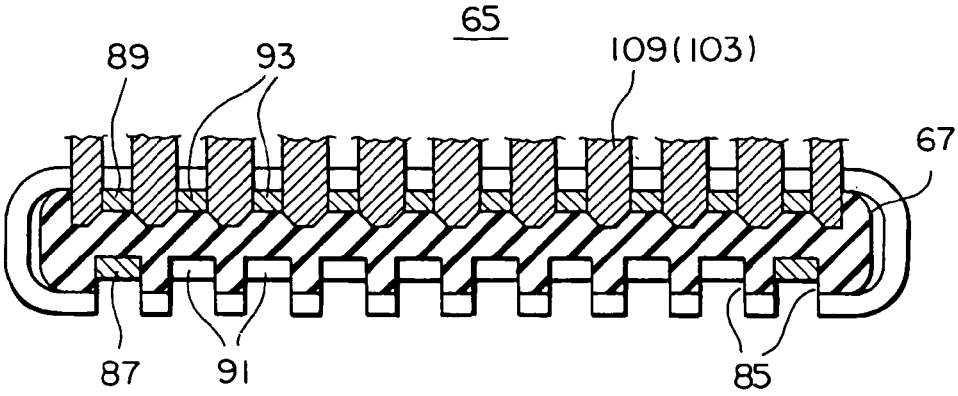
FIG. 12 is a sectional view showing a fixing metal mold for forming a projecting portion of an insulator of the electrical connector shown in FIG. 5.
Figure 13:
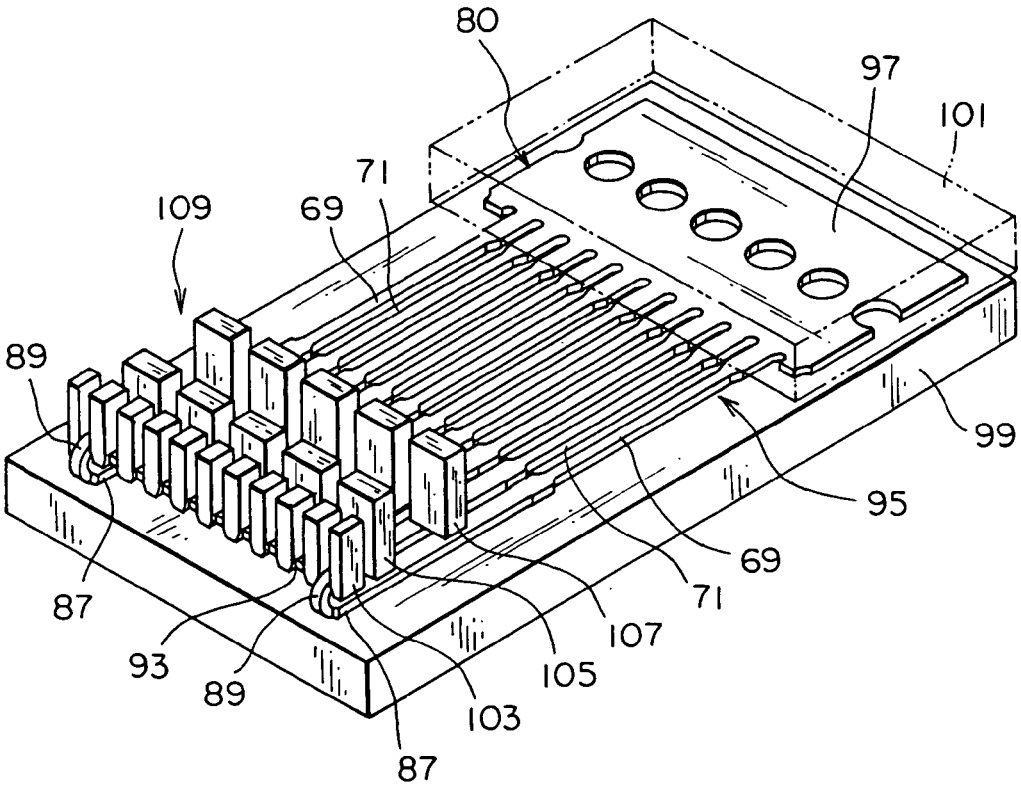
FIG. 13 is a perspective view of the fixing metal mold shown in FIG. 12.

As shown in FIGS. 12 and 13, a contact plate material is formed by pressing out a plate material. The contact plate material has a contact member and a carrier 97 provided with one end of the contact members 97. The carrier 97 is used for carrying and working a contact member and incorporating the contact member in the connector, and therafter being cut away from the contact member 95. In other words, the contact member 95 includes the first and second contacts 69 and 71 and the carrier 97 provided at the rear ends of the contacts 69 and 71 and is integrally formed from one metal plate by press blanking. Further, by simultaneous or subsequent press bending, the tip of each first contact 69 of the contact member 95 is bent into a U-shape from upward to backward, and the tip of each second contact 71 of the contact member 95 is bent upward and then forward to form a step, i.e. bent into, so to speak, an angular S-shape (continued LL-shape).

Figure 5:
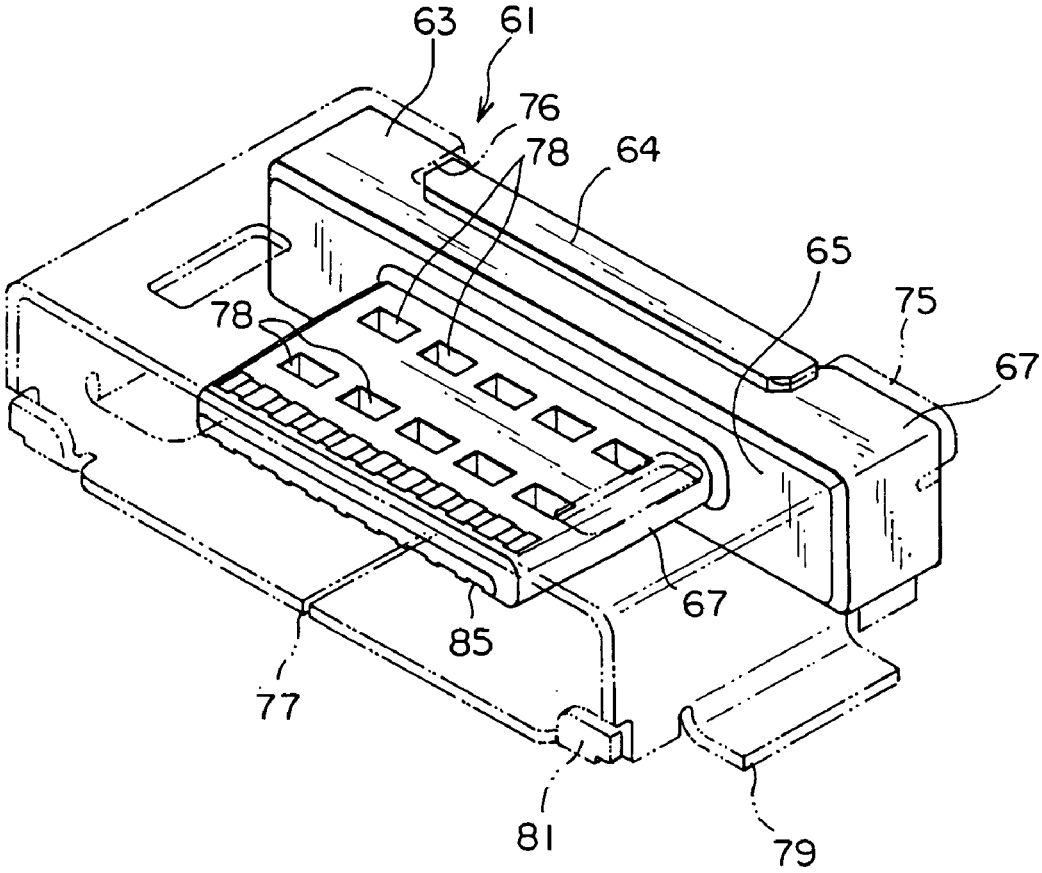
FIG. 5 is a perspective view showing an electrical connector according to a preferred embodiment of the present invention.
Figure 6:
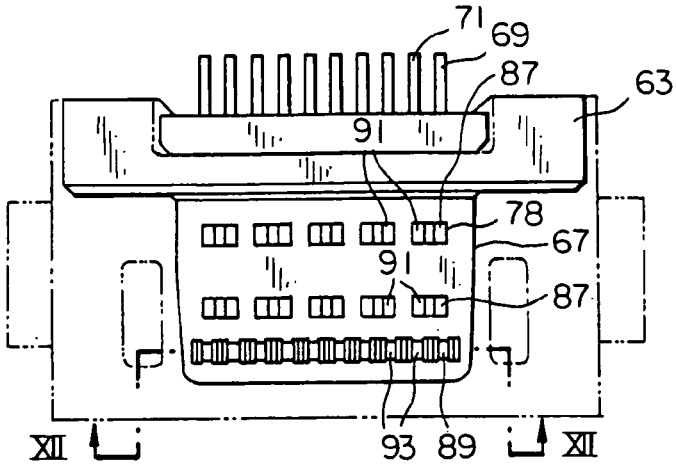
FIG. 6 is a plan view of the electrical connector shown in FIG. 5.
Figure 7:
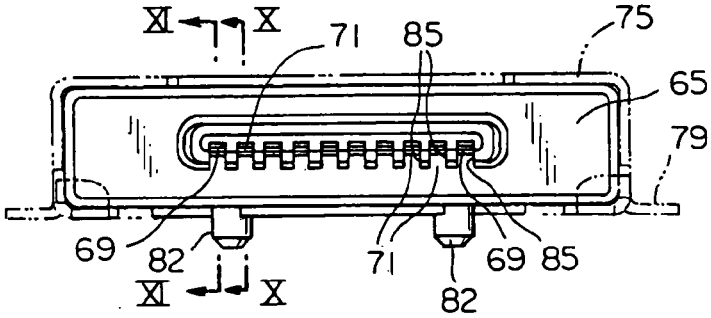
FIG. 7 is a front view of the electrical connector shown in FIG. 5.
Figure 8:
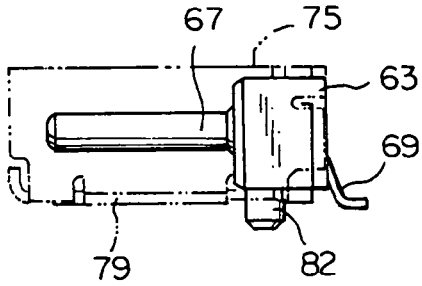
FIG. 8 is a side view of the electrical connector shown in FIG. 5.
Figure 9:
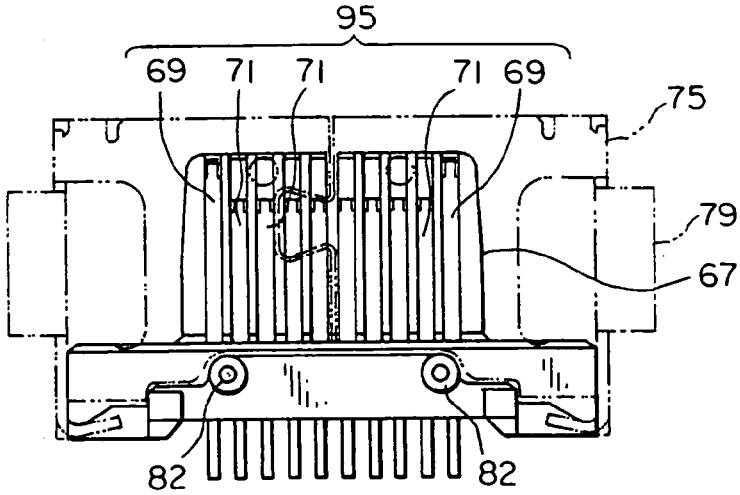
FIG. 9 is a bottom view of the electrical connector shown in FIG. 5.

The contact member 95 is placed on a lower supporter 99, and the carrier 97 is further supported by an upper supporter 101. By the use of a fixing metal mold 109 composed of first, second, and third metal mold parts 103, 105, and 107, the second contact portions 89 and 93 of the first and second contacts 69 and 71 are each sandwiched between the first metal mold parts 103, while the first contact portions 87 and 91 of the first and second contacts 69 and 71 located backward of the second contact portions 89 and 93 are pressed down by the second and third metal mold parts 105 and 107 such that each of the second and third metal mold parts 105 and 107 arranged in two rows spaced apart in the forward/backward direction straddles the adjacent two first contact portions 87 and 91 or the adjacent two first contact portions 91 and 91. By carrying out overmolding with resin in the state of FIG. 13, the connector shown in FIG. 5 is produced, wherein the projecting portion 67 of the insulator 63 is formed with the holes 78 from which the second and third metal mold parts 105 and 107 are respectively extracted.

According to the preferred embodiment of the present invention described above, in the electrical connector wherein the active-line type contacts are overmolded, it is possible to provide the structure wherein the pitch direction deflection of the first and second contacts 69 and 71 can be prevented by means of the metal mold structure, by bending the tip portion of each contact on the contacting side thereof and exposing it from the back side of the contacting surface of the contact.

Further, by exposing the second contact portions 89 and 93 of the first and second contacts 69 and 71 from the reverse side of the first contact portions 87 and 91 on the contacting side of the first and second contacts 69 and 71, it is possible to provide auxiliary contacting surfaces.

As described above, in the electrical connector according to the preferred embodiment of the present invention, it is possible to provide the contact deflection countermeasure shape on the reverse side of the fitting surface upon molding, by bending the tip portion of each of the first and second contacts 69 and 71. Even in case of the active-line type contacts, by matching the exposed surfaces of the contacts on the reverse side of the fitting surfaces, it is possible to use the same shape at corresponding portions of the metal mold, and is further possible to provide the auxiliary contacting surfaces on the reverse side of the contacting surfaces of the fitting portion.

Even in case of the active-line type contacts (two kinds of contacts), it is possible to provide the contacting surfaces on the same line by changing the bending shapes of the contacts. By providing the contacting surfaces on the same line, the contacts of the counterpart connector may have only one kind of shape.

Figure 14:
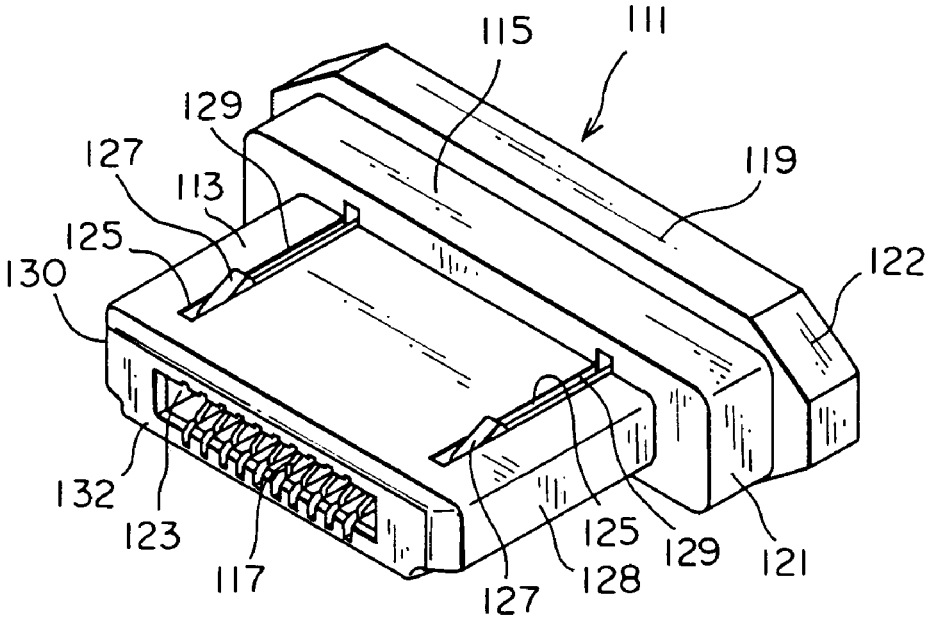
FIG. 14 is a perspective view showing a counterpart connector to be fitted to the electrical connector according to the preferred embodiment of the present invention.
Figure 15:
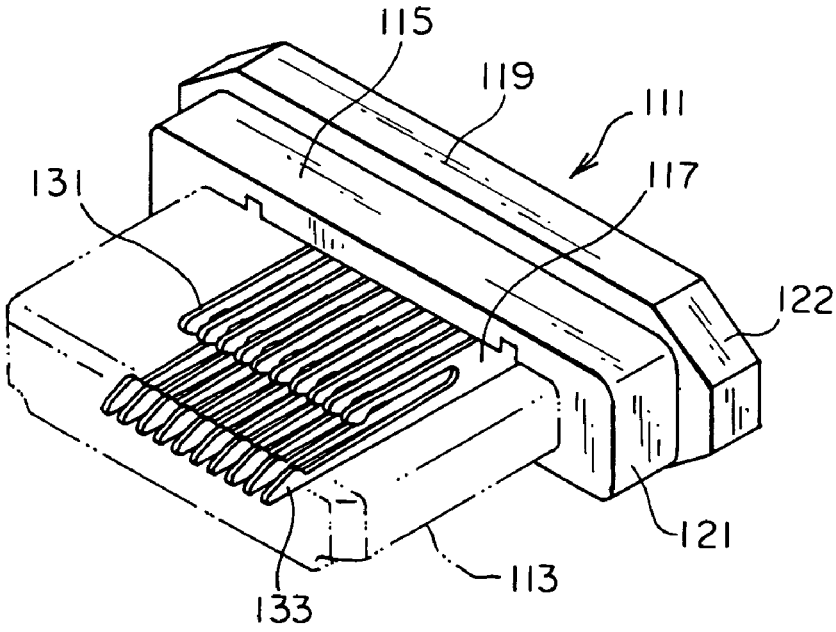
FIG. 15 is a perspective view of the counterpart connector shown in FIG. 14, showing the state where a fitting portion thereof is omitted.

As shown in FIGS. 14 and 15, a counterpart connector 111 has a three-step prismatic shape and contains an insulator 115 having a box-shaped projecting portion 113, and contacts 117 retained by the insulator 115. The insulator 115 contains a rectangular plate 119 having chamfered corners, a rectangular plate 121 that is one size smaller than the rectangular plate 119, and the projecting portion 113 having both side surfaces 132 and 130 and extending forward like a flat plate from the rectangular plate 121, which are continuously arranged in an axial direction and formed integral with each other to constitute the insulator 115. The projecting portion 113 has a front end surface 128 formed with an opening 123. A through hole is formed so as to extend backward from the opening 123 to thereby define a contact receiving space. Further, each of grooves 125 is formed on both sides of an upper surface of the projecting portion 113. In each of grooves, an engaging piece 129 is provided which has an engaging claw 127. The engaging claw 127 serves to prevent detachment of the electrical connector 61 and the counterpart connector 111 from each other in directions along fitting directions of the mutual connectors when the counterpart connector 111 and the electrical connector 61 are fitted together. The engaging piece 129 is received in each groove 125 so as to support an opposite side of the engaging claw 127. The engaging piece 129 has springiness and is configured to be urged upward when the electrical connector 61 depresses the engaging claw 127, thereby to engage with the electrical connector 61.

Figure 3:
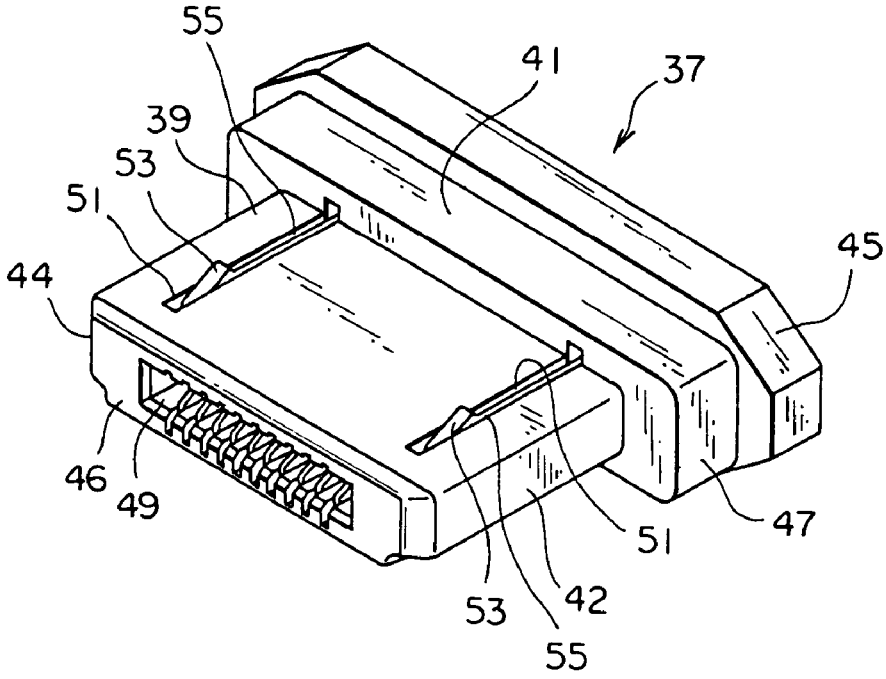
FIG. 3 PRIOR ART
FIG. 3 is a perspective view showing a counterpart connector to be fitted to the conventional electrical connector shown in FIG. 1.
Figure 4:
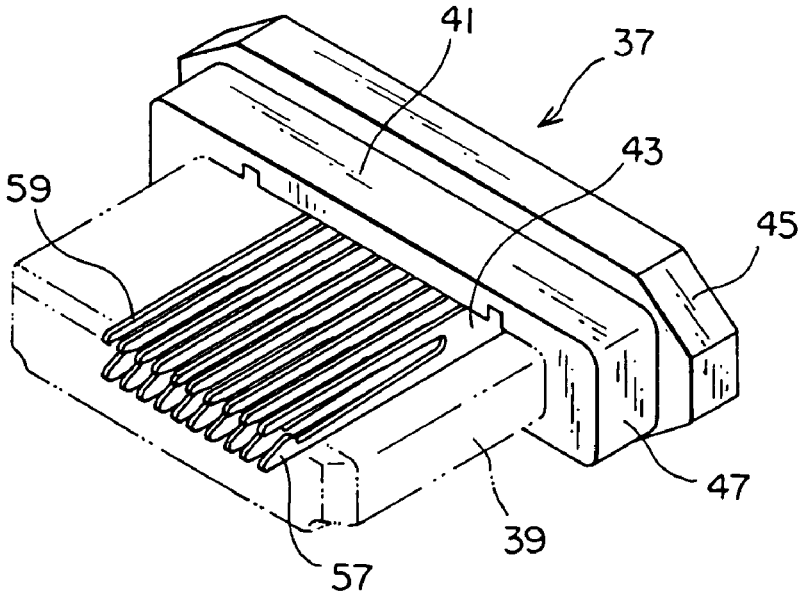
FIG. 4 PRIOR ART
FIG. 4 is a perspective view of the counterpart connector shown in FIG. 3, showing the state where a fitting portion thereof is omitted.

The counterpart connector 111 differs from the conventional counterpart connector 37 shown in FIGS. 3 and 4 in that each of the counterpart contacts 117 is bifurcated so as to have a first contact portion 131 extending toward the opening 123 and a second contact portion 133 extending up to the opening 123, and that the tip of the first contact portion 131 projects in a triangular shape toward the second contact portion 133 to thereby form a contact-point portion, and the tip of the second contact portion 133 projects in a triangular shape toward the first contact portion 131 to thereby form a contact-point portion.

Figure 16:
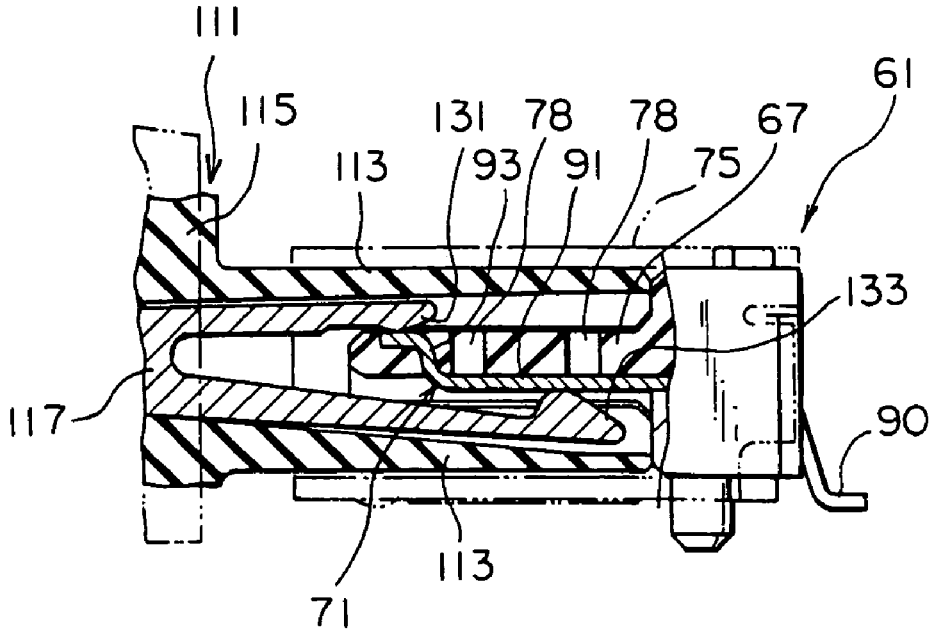
FIG. 16 is a sectional view showing a normal fitting state between the electrical connector according to the preferred embodiment of the present invention and the counterpart connector.

As shown in FIG. 16, when the electrical connector 61 and the counterpart connector 111 are fitted together, the projecting portion 67 of the electrical connector 61 is sandwiched between the first and second contact portions 131 and 133 of the contacts 117 provided in the contact receiving space of the projecting portion 113 of the counterpart connector 111 so that the first contact portions 87 (FIG. 10) and 91 of the first and second contacts 69 (FIG. 10) and 71 of the electrical connector 61 and the contact-point portions of the second contact portions 133 of the contacts 117 of the counterpart connector 111 are brought into contact with each other to thereby establish electrical connection therebetween.

Figure 17:
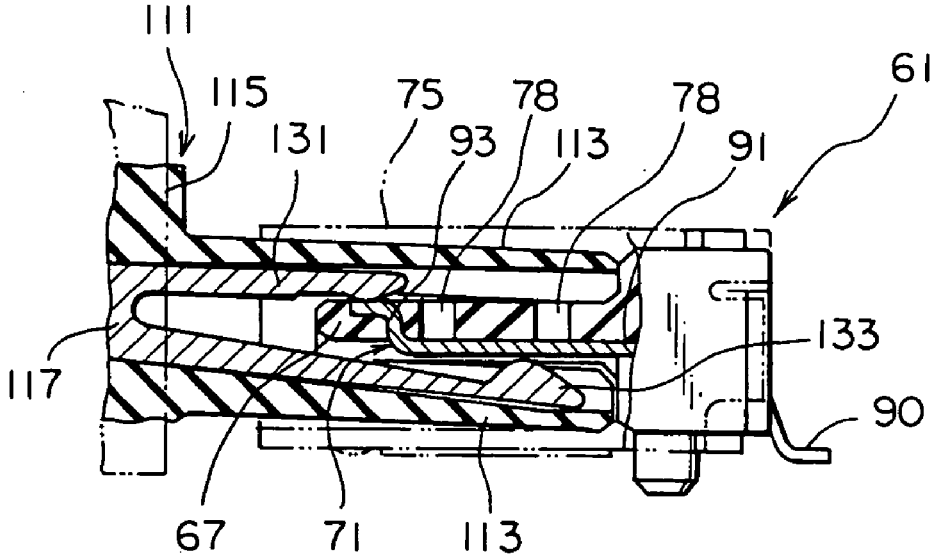
FIG. 17 is a sectional view showing a slanting fitting state between the electrical connector according to the preferred embodiment of the present invention and the counterpart connector.

As shown in FIG. 17, in the electrical connector 61, although the first contact portion 91 of each contact 71 has a contacting surface, which contacts the second contact portion 133 of the counterpart contact 117, on only one side thereof, even when a large force is applied in a direction where the contact 71 moves away from the second contact portion 133, to thereby cause deflection of the peripheral components, the second contact portion 93 of the contact 71 of the electrical connector 61 and the first contact portion 131 of the counterpart contact 117 of the counterpart connector 111 are not separated from each other so that disconnection is not caused.

In the similar manner, in connection with each contact 69 shown in FIG. 10, in the electrical connector 61, although the first contact portion 87 of each contact 69 has a contacting surface, which contacts the second contact portion 133 of the counterpart contact 117, on only one side thereof, even when a large force is applied in a direction where the contact 69 moves away from the second contact portion 133, to thereby cause deflection of the peripheral components, the second contact portion 89 of the contact 69 of the electrical connector 61 and the first contact portion 131 of the counterpart contact 117 of the counterpart connector 111 are not separated from each other so that disconnection is not caused.

The electrical connector according to the preferred embodiment of the present invention is incorporated into a body of each of portable telephones widely used by general users. A connector with cables is used as the counterpart connector, and data communications or the like is carried out in the state where the electrical connector and the counterpart connector are fitted together. Even in the situation where the cables tend to be pulled or where electrical disconnection of the connector is raising a problem, inasmuch as, in the electrical connector according to the preferred embodiment of the present invention, either one of the two contact portions of each contact is brought into contact with the counterpart contact, there is no occurrence of disconnection.

As described above, according to the present invention, it is possible to provide the production method of the electrical connector, which can provide the contact deflection countermeasure on the reverse side of the fitting surface upon molding by bending the tip portion of each contact.

Further, according to the present invention, it is possible to provide the active-line type electrical connector that can ensure reliable contact with the counterpart connector even when an external force is applied to the counterpart connector, by changing the bending shapes of the contacts to thereby provide the contacting surfaces on the same line in the metal mold.

What is claimed is:

1. An electric connector configured to be connected to a mating connector in a fitting direction and comprising contacts and an insulator fixedly retaining said contacts, said mating connector comprising a U-shaped contact comprising a first contact portion and a second contact portion, which are disposed separately from each other in the fitting direction, wherein said insulator comprises a substantially plate-like fitting portion, each of said contacts of the electrical connector comprises a first contact portion and a second contact portion being continuous with said first contact portion of the electrical connector and formed at a tip side of said contact the electrical connector in said fitting direction, wherein said first and second contact portions of the electrical connector are disposed to connect to said first and second contact portions of the mating connector, respectively, said fitting portion is disposed between said first and second contact portions of the mating connector when said electrical connector is connected to said mating connector, and said first contact portion is disposed such that one side of said fitting portion is exposed, and said second contact portion is disposed such that at least part of said second contact portion is exposed at a surface of said fitting portion on the other side of said fitting portion.

2. The electrical connector according to claim 1, wherein said contacts are molded in so as to be formed integral with said insulator.

3. The electrical connector according to claim 1, further comprising a metal shell covering the circumference of said insulator including said fitting portion.

4. The electrical connector according to claim 1, wherein said contacts include a first contact and a second contact each having said first contact portion and said second contact portion, and wherein said second contact portion of said first contact is bent backward so that the tip thereof forms a U-shape, and said second contact portion of said second contact is bent forward so that the tip thereof forms an S-shape.

5. The electrical connector according to claim 2, wherein said contacts include a first contact and a second contact each having said first contact portion and said second contact portion, and wherein said second contact portion of said first contact is bent backward so that the tip thereof forms a U-shape, and said second contact portion of said second contact is bent forward so that the tip thereof forms an S-shape.

6. The electrical connector according to claim 3, wherein said contacts include a first contact and a second contact each having said first contact portion and said second contact portion, and wherein said second contact portion of said first contact is bent backward so that the tip thereof forms a U-shape, and said second contact portion of said second contact is bent forward so that the tip thereof forms an S-shape.

7. A method of producing an electrical connector configured to be connected to a mating connector in a fitting direction and including contacts and an insulator having a substantially plate-like fitting portion that fixedly retains said contacts, said mating connector comprising a U-shaped contact comprising a first contact portion and a second contact portion which are disposed separately from each other in the fitting direction, said fitting portion being disposed between said first and second contact portions of the mating connector when said electrical connector is connected to said mating connector, said method comprising the steps of:

forming a contact member having integrally said contacts and a carrier provided at ends of said contacts and connecting said ends of said contacts together; and forming, at the other end of each of said contacts of the electrical connector, a first contact portion of said electrical connector, and a second contact portion of said electrical connector being continuous with said first contact portion and formed at a tip side of said contact in said fitting direction, said first and second contact portions of the electrical connector are provided for connection to said first and second contact portions of the mating connector, respectively, such that said first contact portion is exposed on one side of said fitting portion, and at least part of said second contact portion is exposed at a surface of said fitting portion on the other side of said fitting portion, fixing said first contact portions spaced apart from each other at a predetermined interval therebetween by the use of a fixing metal mold, and overmolding said contacts to thereby form said contacts integral with said insulator.

8. The method according to claim 7, further comprising the step of forming a metal shell so as to cover the circumference of said insulator including said fitting portion.

9. The method according to claim 7, wherein said contacts include a first contact and a second contact each having said first contact portion and said second contact portion, and wherein said second contact portion of said first contact is bent backward so that the tip thereof forms a U-shape, and said second contact portion of said second contact is bent forward so that the tip thereof forms an S-shape.

10. The method according to claim 7, wherein said contacts include a first contact and a second contact each having said first contact portion and said second contact portion, and wherein said second contact portion of said first contact is bent backward so that the tip thereof forms a U-shape, and said second contact portion of said second contact is bent forward so that the tip thereof forms an S-shape.

* * * * *